US007028926B2

(12) United States Patent
Habib et al.

(10) Patent No.: US 7,028,926 B2
(45) **Date of Patent: *Apr. 18, 2006**

(54) SOOTBLOWER NOZZLE ASSEMBLY WITH NOZZLES HAVING DIFFERENT GEOMETRIES

(75) Inventors: Tony F. Habib, Lancaster, OH (US); David L. Keller, Wadsworth, OH (US); Steven R. Fortner, Lancaster, OH (US)

(73) Assignee: Diamond Power International, Inc., Lancaster, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/808,047

(22) Filed: Mar. 24, 2004

(65) Prior Publication Data

US 2004/0222324 A1 Nov. 11, 2004

Related U.S. Application Data

(63) Continuation-in-part of application No. 10/039,430, filed on Jan. 2, 2002, now Pat. No. 6,764,030.

(60) Provisional application No. 60/524,827, filed on Nov. 24, 2003, provisional application No. 60/261,542, filed on Jan. 12, 2001.

(51) Int. Cl.
*B05B 1/20* (2006.01)

(52) U.S. Cl. ..... 239/566; 239/461; 239/750; 239/752; 239/DIG. 13; 122/392; 15/316.1

(58) Field of Classification Search ..... 239/461, 239/566, 567, 589, 750, 752, 753, DIG. 13; 122/379, 390, 392; 15/316.1, 318.1; 134/56 R, 134/167 C See application file for complete search history.

(56) References Cited

U.S. PATENT DOCUMENTS

| | | | | |
|---|---|---|---|---|
| 1,762,313 | A | 6/1930 | Snow et al. | |
| 1,809,221 | A | 6/1931 | Snow et al. | |
| 1,847,447 | A | 3/1932 | Snow et al. | |
| 1,847,448 | A | 3/1932 | Snow et al. | |
| 1,848,807 | A | 3/1932 | Snow et al. | |
| 1,848,885 | A | 3/1932 | Howse et al. | |
| 2,897,532 | A | 8/1959 | Cantieri | |
| 2,904,260 | A | 9/1959 | Schueler et al. | |
| 2,933,259 | A | 4/1960 | Raskin | |
| 3,068,507 | A | 12/1962 | Evans | |
| 4,209,028 | A | 6/1980 | Shenker | |
| 4,218,016 | A * | 8/1980 | Freund | 239/DIG. 13 |
| 4,359,800 | A | 11/1982 | Ziels | |

(Continued)

FOREIGN PATENT DOCUMENTS

BE 669895 1/1966

(Continued)

OTHER PUBLICATIONS

Internal Corporate Document Describing Prior Art Nozzle Designs.

*Primary Examiner*—Steven J. Ganey
(74) *Attorney, Agent, or Firm*—Brinks Hofer Gilson & Lione

(57) ABSTRACT

In accordance with the teachings of the present invention, a sootblower design incorporates a downstream nozzle positioned on a nozzle block body and an upstream nozzle positioned longitudinally from the position of the downstream nozzle farther from a distal end of the nozzle block than that of the downstream nozzle. The upstream nozzle has a geometry that is different than the geometry of the downstream nozzle. By having nozzles of different geometries, each nozzle can be individually optimized for the flow conditions each nozzle experiences.

11 Claims, 9 Drawing Sheets

U.S. PATENT DOCUMENTS

| | | | | |
|---|---|---|---|---|
| 4,503,811 | A * | 3/1985 | Hammond | 122/392 |
| 4,567,622 | A | 2/1986 | Ziels | |
| 4,773,357 | A | 9/1988 | Scharton et al. | |
| 5,063,632 | A | 11/1991 | Clark et al. | |
| 5,230,306 | A | 7/1993 | Barringer et al. | |
| 5,241,723 | A | 9/1993 | Garrabrant | |
| 5,271,356 | A | 12/1993 | Kling et al. | |
| 5,277,153 | A | 1/1994 | Kakabaker | |
| 5,375,771 | A | 12/1994 | Jameel et al. | |
| 5,379,727 | A | 1/1995 | Kling et al. | |
| 5,423,483 | A | 6/1995 | Schwade | |
| 5,505,163 | A | 4/1996 | Jameel | |
| 5,509,607 | A * | 4/1996 | Booher et al. | 15/316.1 |
| 5,667,139 | A | 9/1997 | Dickie | |
| 5,778,831 | A | 7/1998 | Jameel | |
| 5,794,857 | A | 8/1998 | Chen et al. | |

FOREIGN PATENT DOCUMENTS

| | | |
|---|---|---|
| DE | 137814 | 9/1979 |
| DE | 94 18 733.9 | 2/1995 |
| DK | 116130 | 4/1946 |
| EP | 1 223 401 A2 | 7/2002 |
| GB | 170991 | 11/1921 |
| GB | 242818 | 11/1925 |
| JP | 57-157927 | 9/1982 |
| WO | WO 97/38264 | 10/1997 |

* cited by examiner

SOOTBLOWER NOZZLE ASSEMBLY WITH NOZZLES HAVING DIFFERENT GEOMETRIES

RELATED APPLICATIONS

This application claims the benefit of U.S. Provisional Application No. 60/524,827, filed Nov. 24, 2003, and is a continuation-in-part of U.S. application Ser. No. 10/039,430, filed Jan. 2, 2002 now U.S. Pat. No. 6,764,030, which claims the benefit of U.S. Provisional Application No. 60/261,542, filed Jan. 12, 2001.

The entire contents of the above applications are incorporated herein by reference.

BACKGROUND

This invention generally relates to a sootblower device for cleaning interior surfaces of large-scale combustion devices. More specifically, this invention relates to new designs of nozzles for a sootblower lance tube providing enhanced cleaning performance.

Sootblowers are used to project a stream of a blowing medium, such as steam, air, or water against heat exchanger surfaces of large-scale combustion devices, such as utility boilers and process recovery boilers. In operation, combustion products cause slag and ash encrustation to build on heat transfer surfaces, degrading thermal performance of the system. Sootblowers are periodically operated to clean the surfaces to restore desired operational characteristics. Generally, sootblowers include a lance tube that is connected to a pressurized source of blowing medium. The sootblowers also include at least one nozzle from which the blowing medium is discharged in a stream or jet. In a retracting sootblower, the lance tube is periodically advanced into and retracted from the interior of the boiler as the blowing medium is discharged from the nozzles. In a stationary sootblower, the lance tube is fixed in position within the boiler but may be periodically rotated while the blowing medium is discharged from the nozzles. In either type, the impact of the discharged blowing medium with the deposits accumulated on the heat exchange surfaces dislodges the deposits. U.S. Patents which generally disclose sootblowers include the following, which are hereby incorporated by reference U.S. Pat. Nos. 3,439,376; 3,585,673; 3,782,336; and 4,422,882.

A typical sootblower lance tube comprises at least two nozzles that are typically diametrically oriented to discharge streams in directions 180° from one another. These nozzles may be directly opposing, i.e. at the same longitudinal position along the lance tube or are longitudinally separated from each other. In the latter case, the nozzle closer to the distal end of the lance tube is typically referred to as the downstream nozzle. The nozzle longitudinally furthest from the distal end is commonly referred to as the upstream nozzle. The nozzles are generally but not always oriented with their central passage perpendicular to and intersecting the longitudinal axis of the lance tube and are positioned near the distal end of the lance tube.

Various cleaning mediums are used in sootblowers. Steam is commonly used. Cleaning of slag and ash encrustations within the internal surfaces of a combustion device occurs through a combination of mechanical and thermal shock caused by the impact of the cleaning medium. In order to maximize this effect, lance tubes and nozzles are designed to produce a coherent stream of cleaning medium having a high peak impact pressure on the surface being cleaned.

Nozzle performance is generally quantified by measuring dynamic pressure impacting a surface located at the intersection of the centerline of the nozzle at a given distance from the nozzle. In order to maximize the cleaning effect, it is generally preferred to have the stream of compressible blowing medium fully expanded as it exits the nozzle. Full expansion refers to a condition in which the static pressure of the stream exiting the nozzle approaches that of the ambient pressure within the boiler. The degree of expansion that a jet undergoes as it passes through the nozzle is dependent, in part, on the throat diameter, the length of the expansion zone within the nozzle, and the expansion angle.

Classical supersonic nozzle design theory for compressible fluids such as air or steam require that the nozzle have a minimum flow cross-sectional area often referred to as the throat, followed by an expanding cross-sectional area (expansion zone) which allows the pressure of the fluid to be reduced as it passes through the nozzle and accelerates the flow to velocities higher than the speed of sound. Various nozzle designs have been developed that optimize the expansion of the stream or jet, as it exits the nozzle. Constraining the practical lengths that sootblower nozzles can have is a requirement that the lance assembly must pass through a small opening in the exterior wall of the boiler, called a wall box. For long retracting sootblowers, the lance tubes typically have a diameter on the order of three to five inches. Nozzles for such lance tubes cannot extend a significant distance beyond the exterior cylindrical surface of the lance tube. In applications in which two nozzles are diametrically opposed, severe limitations in extending the length of the nozzles are imposed to avoid direct physical interference between the nozzles or an unacceptable restriction of fluid flow into the nozzle inlets occurs.

In an effort to permit longer sootblower nozzles, nozzles of sootblower lance tubes are frequently longitudinally displaced. Although this configuration generally enhances performance, it has been found that the upstream nozzle exhibits significantly better performance than the downstream nozzle. Thus, an undesirable difference in cleaning effect results between the nozzles.

SUMMARY OF THE INVENTION

In accordance with this invention, improvements in nozzle design are provided for optimized performance of the downstream and upstream nozzles.

Briefly, a first embodiment of the present invention includes a downstream nozzle positioned on a nozzle block body and an upstream nozzle positioned longitudinally from the position of the downstream nozzle farther from the distal end than that of the downstream nozzle. The upstream nozzle has a geometry that is different than the geometry of the downstream nozzle. By having nozzles of different geometries, each nozzle can be individually optimized for the flow conditions each nozzle experiences. Thus, the flow expansion through each nozzle can be optimized for the flow conditions encountered by each nozzle.

In various configurations, the geometry of each nozzle can be defined by one or more parameters, such as an expansion length of the expansion zone, an exit area or diameter of an outlet end, and a throat area or diameter. In some configurations, the downstream nozzle has an expansion length that differs from that of the upstream nozzle. In particular embodiments, the ratio of the exit area to the throat area of the downstream nozzle is different than the ratio of the exit area to the throat area of the upstream nozzle. The ratio of the expansion length to the exit diameter for one nozzle may be different than that of the other nozzle. Further, the ratio of the expansion length to the throat diameter of the downstream nozzle may be different than the expansion length to the throat diameter of the upstream nozzle.

BRIEF DESCRIPTION OF THE DRAWINGS

Further features and advantages of the invention will become apparent from the following discussion and accompanying drawings, in which.

DETAILED DESCRIPTION

The following description of the preferred embodiment is merely exemplary in nature, and is in no way intended to limit the invention or its application or uses.

Figure 1:
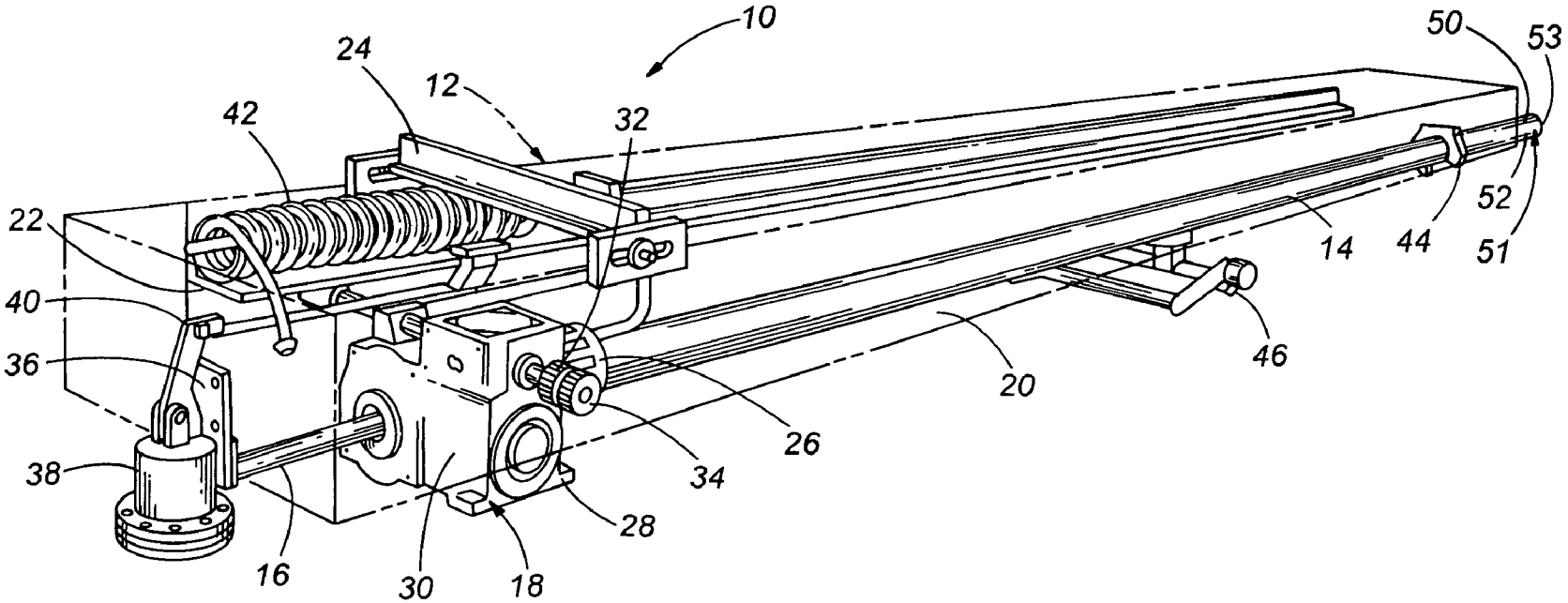
Figure - 1 Prior Art
FIG. 1 is a pictorial view of a long retracting sootblower which is one type of sootblower which may incorporate the nozzle assemblies of the present invention.

A representative sootblower, is shown in FIG. 1 and is generally designated there by reference number 10. Sootblower 10 principally comprises frame assembly 12, lance tube 14, feed tube 16, and carriage 18. Sootblower 10 is shown in its normal retracted resting position. Upon actuation, lance tube 14 is extended into and retracted from a combustion system such as a boiler (not shown) and may be simultaneously rotated.

Frame assembly 12 includes a generally rectangularly shaped frame box 20, which forms a housing for the entire unit. Carriage 18 is guided along two pairs of tracks located on opposite sides of frame box 20, including a pair of lower tracks (not shown) and upper tracks 22. A pair of toothed racks (not shown) are rigidly connected to upper tracks 22 and are provided to enable longitudinal movement of carriage 18. Frame assembly 12 is supported at a wall box (not shown) which is affixed to the boiler wall or another mounting structure and is further supported by rear support brackets 24.

Carriage 18 drives lance tube 14 into and out of the boiler and includes drive motor 26 and gear box 28 which is enclosed by housing 30. Carriage 18 drives a pair of pinion gears 32 which engage the toothed racks to advance the carriage and lance tube 14. Support rollers 34 engage the guide tracks to support carriage 18.

Feed tube 16 is attached at one end to rear bracket 36 and conducts the flow of cleaning medium which is controlled through the action of poppet valve 38. Poppet valve 38 is actuated through linkages 40 which are engaged by carriage 18 to begin cleaning medium discharge upon extension of lance tube 14, and cuts off the flow once the lance tube and carriage return to their idle retracted position, as shown in FIG. 1. Lance tube 14 over-fits feed tube 16 and a fluid seal between them is provided by packing (not shown). A sootblowing medium such as air or steam flows inside of lance tube 14 and exits through one or more nozzles 50 mounted to nozzle block 52, which defines a distal end 51. The distal end 51 is closed by a semispherical wall 53. The nozzle block 52 can be attached, for example, by welding, to the lance tube 14, or the nozzle block can be defined as the end of the lance tube. The nozzles 50 can be welded in holes bored into the block 52, or the nozzles can be cut into the nozzle block such that the nozzles and block are a one-piece unit.

Coiled electrical cable 42 conducts power to the drive motor 26. Front support bracket 44 supports lance tube 14 during its longitudinal and rotational motion. For long lance tube lengths, an intermediate support 46 may be provided to prevent excessive bending deflection of the lance tube.

Figure 2:
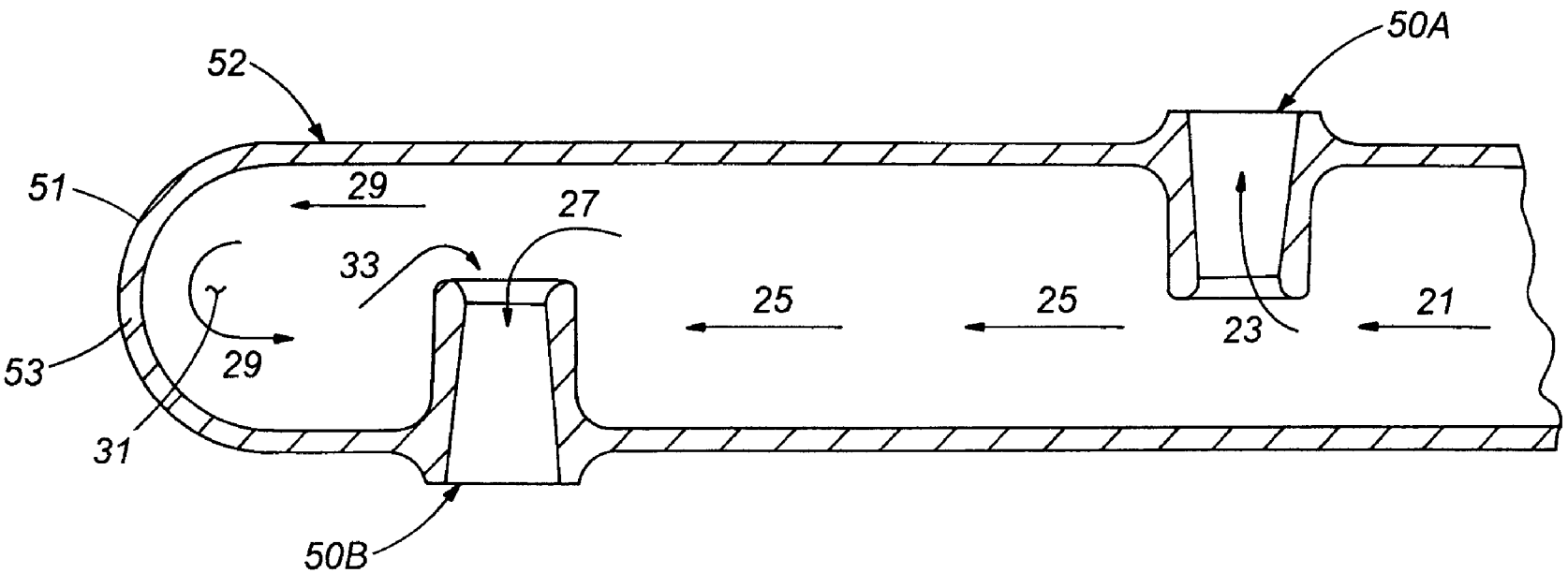
Figure - 2 Prior Art
FIG. 2 is a cross-sectional view of a sootblower nozzle block according to prior art teachings.

Now with reference to FIG. 2, a more detailed illustration of a nozzle block 52 according to prior art is provided. As shown, nozzle block 52 includes a pair of diametrically opposite positioned nozzles 50A and 50B. The nozzles 50A and 50B are displaced from the distal end 51, with nozzle 50B being referred to as the downstream nozzle (closer to distal end 51) and nozzle 50A being the upstream nozzle (farther from distal end 51).

The cleaning medium, typically steam under a gage pressure of about 150 psi or higher, flows into nozzle block 52 in the direction as indicated by arrow 21. A portion of the cleaning medium enters and is discharged from the upstream nozzle 50A as designated by arrow 23. A portion of the flow designated by arrows 25 passes the nozzle 50A and continues to flow toward downstream nozzle 50B. Some of that fluid directly exits nozzle 50B, designated by arrow 27. As explained above, the downstream nozzle 50B typically exhibits lower performance as compared to the upstream nozzle 50A. This is attributed to the fact that the flow of cleaning medium that passes the upstream nozzle 50A and downstream nozzle 50B designated by arrows 29 comes to a complete halt (stagnates) at the distal end 51 of the lance tube 14, thereby creating a stagnation region 31 at the distal end 51 beyond downstream nozzle 50B. Hence, the cleaning medium represented by arrow 33 has to re-accelerate, flow backward and merge with the incoming flow 27. The merging of the forward flow represented by arrow 27 and backward flow represented by arrow 33 results in loss of energy due to hydraulic losses at the nozzle inlet, and also results in flow mal-distribution. The loss of energy associated with stagnation conditions at the distal end and hydraulic losses at the nozzle inlet, and the deformation of the inlet flow profile is believed to be responsible for the downstream nozzle's lower performance in prior art designs.

As mentioned previously, there are various explanations for the comparatively lower performance of downstream nozzle 50B as compared with nozzle 50A. These inventors have found that the performance of the nozzles are enhanced by using upstream and downstream nozzles of different geometries.

One of the key parameters in designing an efficient convergent-divergent Laval nozzle, such as nozzles 50A and 50B, is the throat-to-exit area ratio (Ae/At). A nozzle with an ideal throat-to-exit area ratio would achieve uniform, fully expanded, flow at the nozzle exit plane. The amount of gas acceleration in the divergent section is given by the following equation, which characterizes cleaning medium flow as one-dimensional for the sake of simplified calculation:

$$\frac{A_e}{A_t} = \frac{1}{M_e}\left[\left(\frac{2}{\gamma+1}\right)\left(1+\frac{\gamma-1}{2}M_e^2\right)\right]^{\frac{(\gamma+1)}{2(\gamma-1)}} \tag{1}$$

Where,

Ae=Nozzle exit area

At=Throat area which is also equal to the area of the ideal sonic plane

The exit Mach number in equation (1), Me, is related to the throat-to-exit area ratio via the continuity equation and the isentropic relations of an ideal gas (See Michael A. Saad, "Compressible Fluid Flow", Prentice Hall, Second Edition, page 98.).

The exit Mach number, Me, is also related to the exit pressure via energy relationships as follows:

$$P_e = P_o\left[1+\frac{\gamma-1}{2}M_e^2\right]^{\frac{\gamma}{1-\gamma}} \tag{2}$$

where,

γ=Specific heat ratio of cleaning fluid. For air γ=1.4. For steam, γ=1.329

Pe=Nozzle exit static pressure, psia

Po=Total pressure, psia

Me=Nozzle exit Mach number

From equations (1) & (2), the nozzle exit pressure, Pe, can be directly related to the throat-to-exit area ratio. So, for a given cleaning pressure a near atmospheric nozzle exit pressure can be achieved by the proper selection of the throat-to-exit area ratio.

In equation (1), the relationship between the Mach number and the throat-to-exit area ratio is based on the assumption that the flow reaches the speed of sound at the plane of the smallest cross-sectional area of the convergent-divergent nozzle, nominally the throat. However, in practice, especially in sootblower applications, the flow does not reach the speed of sound at the throat, and not even in the same plane. The actual sonic plane is usually skewered further downstream from the throat, and its shape becomes more non-uniform and three-dimensional.

The distortion of the sonic plane is mainly due to the flow mal-distribution into the nozzle inlet section. In sootblower applications, as shown by arrows 23 for nozzle 50A and arrows 33 and 27 for nozzle 50B in FIG. 2, the cleaning fluid approaches the nozzle at 90° off its center axis. With such configuration, the flow entering the nozzle favors the downstream half of the nozzle inlet section because the entry angle is less steep.

The distortion and dislocation of the sonic plane consequently impacts the expansion of the cleaning fluid in the divergent section, and results in non-uniformly distributed exit pressure and Mach number. These findings were consistent with the measured and predicted exit static pressure for one of the conventional sootblower nozzles.

To account for the shift in the sonic plane, the actual Mach number at the exit can be related to the ideal throat-to-exit area as follows:

$$\frac{A_e}{A_t}\cdot\frac{A_t}{A_{t_a}} = \frac{1}{M_{e_a}}\left[\left(\frac{2}{\gamma+1}\right)\left(1+\frac{\gamma-1}{2}M_{e_a}^2\right)\right]^{\frac{(\gamma+1)}{2(\gamma-1)}} \tag{3}$$

where,

At_a=Effective area of the actual sonic plane

Me_a=Average of the actual Mach number at the nozzle exit

The degree of mal-distribution of the exit Mach number and the static pressure varies between the upstream and downstream nozzles 50A and 50B respectively of a sootblower. It appears that the downstream nozzle 50B exhibits more non-uniform exit conditions than the upstream nozzle 50A, which is believed to be part of the cause of its relatively poor performance.

The location of the downstream nozzle 50B relative to the distal end 51 not only causes greater hydraulic losses, but also causes further misalignment of the incoming flow streams with the nozzle inlet. Again, greater flow mal-distribution at the nozzle inlet would translate to greater shift and distortion in the sonic plane, and consequently poorer performance. For the prior art designs, the ratio (At/At_a) is smaller for the downstream nozzle 50B compared to the upstream nozzle 50A.

In designing more efficient sootblower nozzles, it is necessary to keep the ideal and actual area ratio (At/At_a) closer to unity. Several methods are proposed in this discovery to accomplish this goal. For the upstream nozzle, the "At/At_a" ratio is in part influenced by dimension "X" and "α" shown in FIG. 2A, (At/At_a)=f(α, X). Dimension X designates the longitudinal separation between nozzles 50A and 50B.

A smaller spacing X would cause the incoming flow stream 27 to become more mis-aligned with the upstream nozzle axis. For example, a nozzle assembly with a five inch space for X has a relatively better performance than a nozzle with a four inch spacing for X.

While the greater X distance is beneficial, it is at the same time desired in most sootblower applications to keep X to a minimum for mechanical reasons. In such circumstances, an optimum X distance should be used which would minimize flow disturbance and yet satisfy mechanical requirements. Also, reducing the flow streams approach angle (α) shown in FIG. 2A would reduce flow mal-distribution at the nozzle inlet, and potentially reduce inlet losses. The distance X must also be selected in relation to the helical pitch of advancement of the lance tube 14, since it is preferred that the jets form each nozzle do not impact the same surfaces.

Figure 2A:
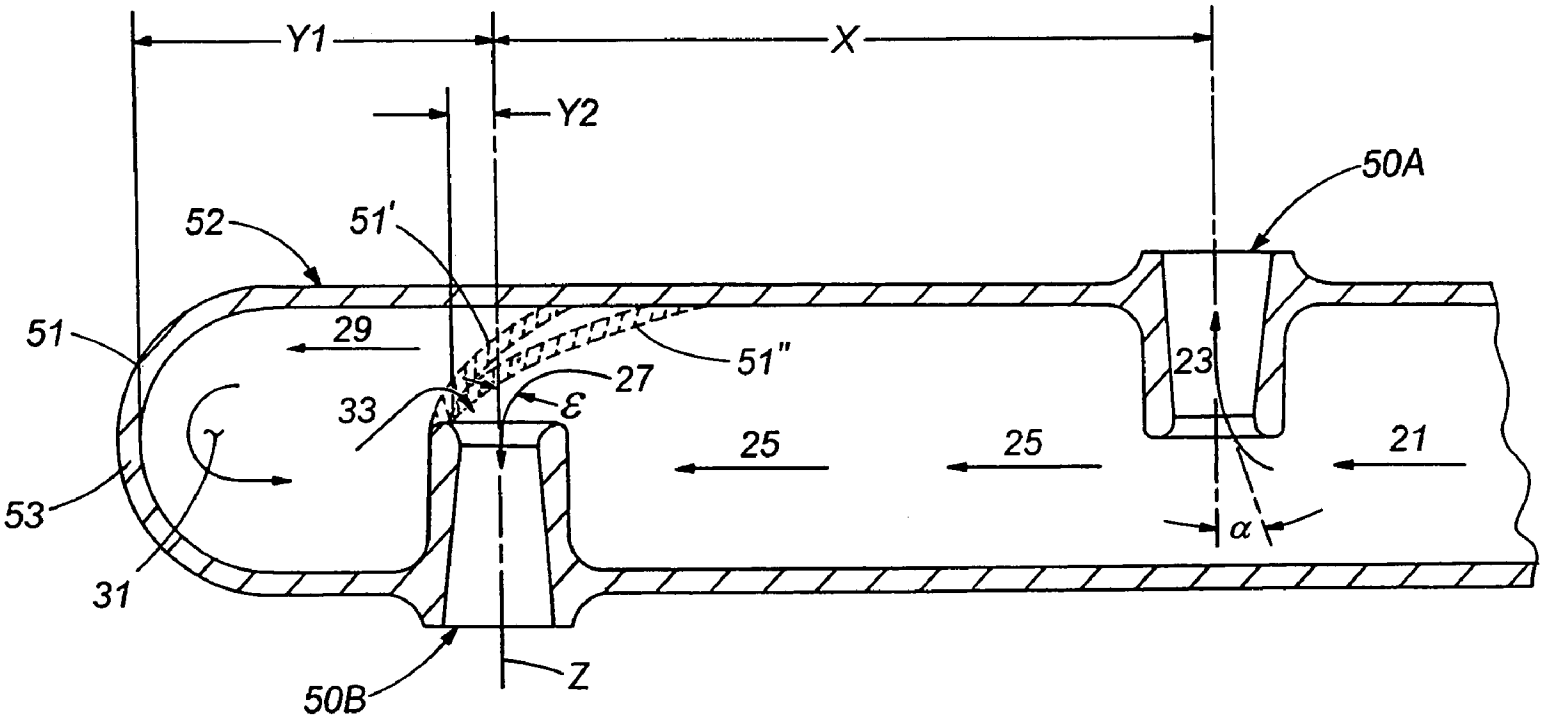
Figure - 2A Prior Art
FIG. 2A is a cross section view similar to FIG. 2 but showing alternative stagnation regions for the nozzle head.

For downstream nozzle 50B, the "At/At_a" ratio is in part influenced by dimension "Y" shown in FIG. 2A, (At/At_a=f(Y)). Dimension Y is defined as the longitudinal distance between the inside surface of distal end 51 and the inlet axis of downstream nozzle 50B.

Again referring to FIG. 2A, the location of the distal plane relative to the downstream nozzle 50B, influences the alignment of the flow stream into the nozzle and causes greater flow mal-distribution. For instance, Y1 (which typifies the prior art) is the least favorable distance between the nozzle center axis and the distal end 51 of the lance tube. With such configuration, the nozzle performance is relatively poor. Y2 is an improved distance which is based on a modified distal end surface designated as 51'. In the case of Y2, the cleaning fluid 25 does not flow past the downstream nozzle 50B, therefore eliminating stagnation conditions of the flows represented by arrows 29 and 33. Instead the flow is efficiently channeled to the nozzle inlet. Thus, if the dimension Y is assumed positive in the left hand direction along the longitudinal axis of nozzle block 52 shown in FIG. 2A, there is an absence of any substantial flow of cleaning medium in the negative Y direction. Also, if the longitudinal axis (shown as a dashed line) of nozzle 50B defines a Z axis assumed positive in the direction of discharge from the nozzle, then it is further true that once the longitudinal point is reached along the nozzle block 52 where flow first begins to enter downstream nozzle 50B, there is a complete absence of any flow velocity vector having a negative Z component. In this way the hydraulic and energy losses at the nozzle inlet are minimized, improving the performance of downstream nozzle 50B. Furthermore, with this improvement the cleaning fluid enters the downstream nozzle 50B more uniformly, therefore minimizing the distortion of the sonic plane which in turn enhances the fluid expansion and the conversion of total pressure to kinetic energy. The optimal value of Y is substantially equal to Y2 which is one-half the diameter of the inlet end of downstream nozzle 50B.

On the other hand, providing a shape of the distal end inside surface to 51" is not beneficial. In such a configuration, the inlet flow area is reduced and the flow streams are further mis-aligned relative to the nozzle center axis (approach angle $\epsilon$ is increased), which could lead to flow separation and greater distortion to the sonic plane.

Figure 3:
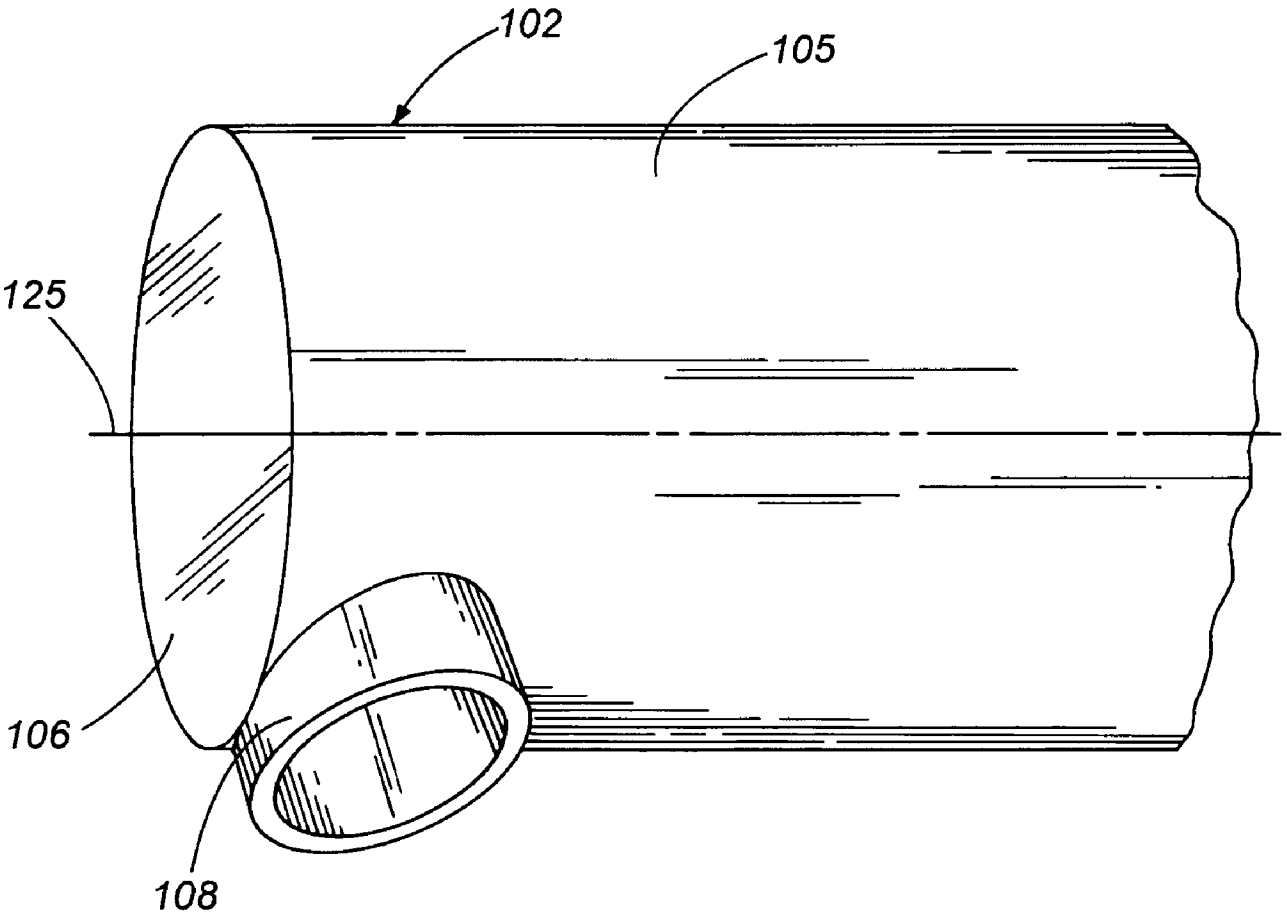
FIG. 3 is a perspective representation of a lance tube nozzle block incorporating the features according to a first embodiment of the invention.
Figure 4:
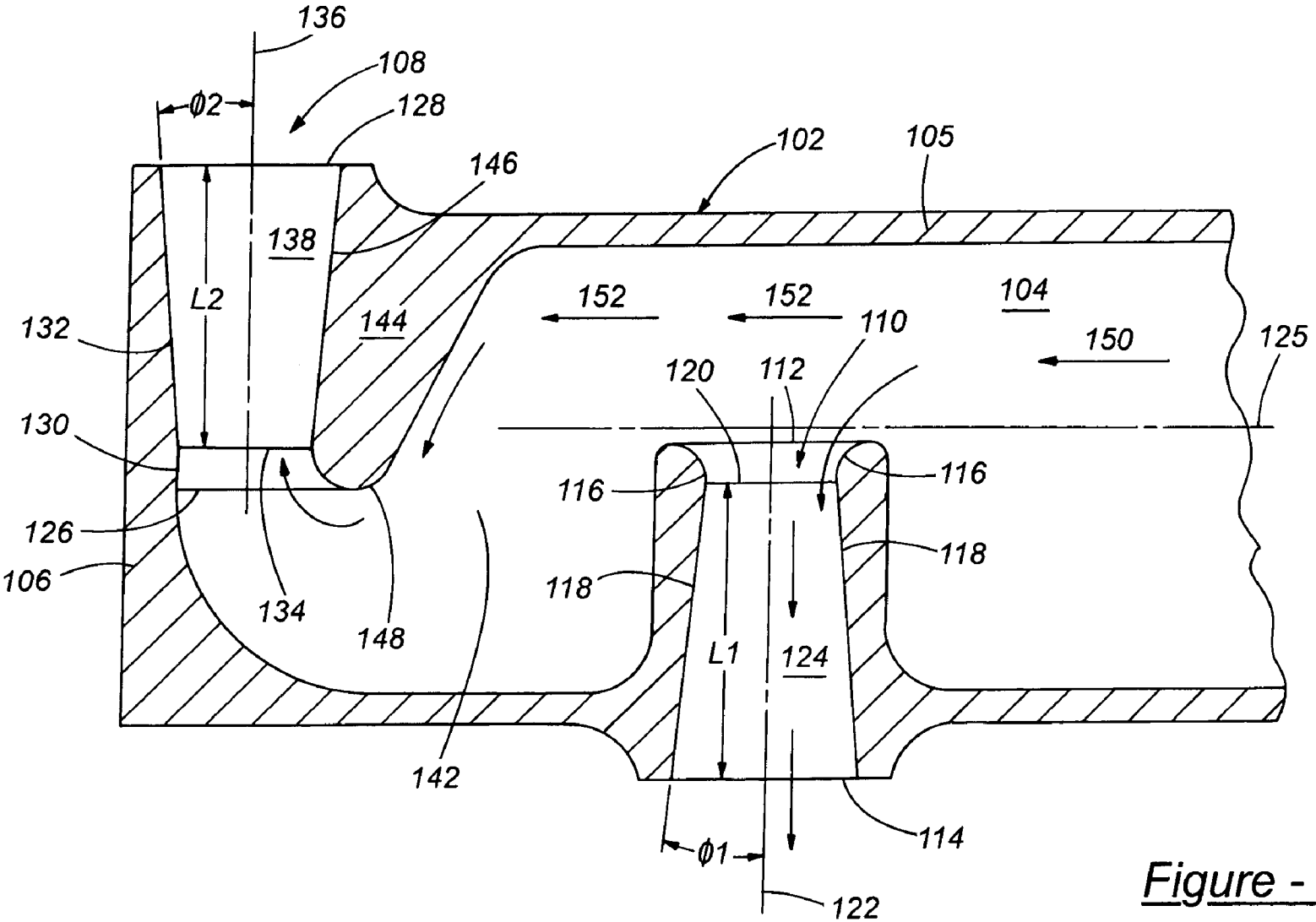
FIG. 4 is a cross section front view of the lance tube nozzle block according to the first embodiment of the present invention as shown in FIG. 3.

Now with reference to FIGS. 3 and 4, a lance tube nozzle block 102 in accordance with the teachings of the first embodiment of this invention is shown. The lance tube nozzle block 102 comprises a hollow interior body or plenum 104 having an exterior surface 105. The distal end of the lance tube nozzle block is generally represented by reference numeral 106. The lance tube nozzle block includes two nozzles 108 and 110 radially positioned and longitudinally spaced. Preferably, lance tube nozzle block 102 and the nozzles 108 and 110 are formed as one integral piece. Alternatively, it is also possible to weld the nozzles into the nozzle block 102.

FIG. 4 illustrates in detail the nozzles 108 and 110. As shown, the nozzle 108 is disposed at the distal end 106 of the lance tube nozzle block 102 and is commonly referred to as the downstream nozzle. The nozzle 110 disposed longitudinally away from the distal end 106 is commonly referred to as the upstream nozzle.

The upstream nozzle 110 is shown which is a typical converging and diverging nozzle of the well-known Laval configuration. In particular, the upstream nozzle 110 defines an inlet end 112 that is in communication with the interior body 104 of the lance tube nozzle block 102. The nozzle 110 also defines an outlet end 114 through which the cleaning medium is discharged. The converging wall 116 and the diverging wall 118 form the throat 120. The central axis 122 of the discharge of the nozzle 110 is substantially perpendicular to the longitudinal axis 125 of the lance tube nozzle block 102. However, it is also possible to have the central axis of discharge 122 oriented within an angle of about seventy degrees (70°) to about an angle substantially perpendicular to the longitudinal axis. The diverging wall 118 of the nozzle 110 defines a divergence angle $\phi$1 as measured from the central axis of discharge 122. The nozzle 110 further defines an expansion zone 124 having a length L1 between the throat 120 and the outlet end 114.

The downstream nozzle 108 also comprises an inlet end 126 and outlet end 128 formed about axis 136. A portion of the cleaning medium not entering the upstream nozzle 110, enters the downstream nozzle 108 at the inlet end 126. The cleaning medium enters the inlet end 126 and exits the nozzle 108, through the outlet end 128. The converging wall 130 and the diverging wall 132 define the throat 134 of the downstream nozzle 108. The plane of the throat 134 is substantially parallel to the longitudinal axis 125 of the nozzle block. The diverging walls 132 of the downstream nozzle 108 are straight, i.e. conical in shape, but other shapes could be used. The central axis 136 of nozzle 108 is oriented within an angle of about seventy degrees (70°) to about an angle substantially perpendicular to the longitudinal axis 125 of the lance tube nozzle block 102. The nozzle 108 defines a divergent angle $\phi$2 as measured from the central axis of discharge 136. An expansion zone 138 having a length L2 is defined between throat 134 and the outlet end 128.

Since the performance of a nozzle depends, in part, on the degree of expansion of the cleaning medium jet that exits through the nozzle. Preferably, the downstream nozzle 108 and the upstream nozzle 110 have different geometries. As such, the performance of each nozzle can be optimized for the flow conditions the respective nozzle experiences, since the flow conditions at one nozzle may be different from the other.

For example, in some configurations, the diameter of throat 134 of the downstream nozzle 108 may be larger than the diameter of throat 120 of the upstream nozzle 110. Further, the length L2 of the expansion chamber 138 may be greater than the length L1 of the expansion chamber 124 of the upstream nozzle 110. In an alternate embodiment, the diameter of the throat 134 is at least 5% larger than the diameter of throat 120 and the length L2 is at least 10% greater than length L1. Hence, the L/D ratio of the downstream nozzle 108 may be larger than the L/D ratio of the upstream nozzle 110. In certain embodiments, the Ae/At ratio of the downstream nozzle 108 may be different than the Ae/At ratio of the upstream nozzle 110. Further, in some embodiments, the ratio of the length L2 of the expansion chamber 138 to the exit area Ae of the outlet end 128 of the downstream nozzle 108 may be different than the ratio of the length L1 of the expansion chamber 124 to the exit area Ae of the outlet end 114 of the upstream nozzle 110.

As shown in FIG. 4, the flow of cleaning medium that passes the upstream nozzle 110 represented by arrow 152 is directed by a converging channel 142. The converging channel 142 is formed in the interior 104 of the lance tube nozzle block 102 between the upstream nozzle 110 and the downstream nozzle 108. The converging channel 142 is preferably formed by placing an aerodynamic converging contour body 144 around the surface of downstream nozzle throat 134. The converging channel 142 gradually decreases the cross-section of the interior 104 of the lance tube nozzle block 102 between the inlet end 112 of the upstream nozzle 110 and the inlet end 126 of the downstream nozzle 108. The tip 148 of the body 144 is in the same plane as the inlet end 126 of the nozzle 108. In the preferred embodiment, the contour body 144 is an integral part of the lance tube nozzle block 102 and the downstream nozzle 108. The contour body 144 has a sloping contour such that the flow of the cleaning medium will be directed toward the inlet end 126 of the downstream nozzle 108. Thus, converging channel 142 presents a cross-sectional flow area for the blowing medium which smoothly reduces from just past upstream nozzle 110 to the downstream nozzle 108 and turns the flow of cleaning medium to enter the downstream nozzle with reduced hydraulic losses.

When the nozzle block 102 is in operation, the cleaning medium flows in the interior 104 of the lance tube nozzle block 102 in the direction shown by arrows 150. A portion of the cleaning medium enters the upstream nozzle 110 through the inlet end 112. The cleaning medium then enters the throat 120 where the medium may reach the speed of sound. The medium then enters the expansion chamber 124 where it is further accelerated and exits the upstream nozzle 110 at the outlet end 114.

A portion of the cleaning medium not entering the inlet end 112 of the upstream nozzle 110 flows towards the downstream nozzle 108 as indicated by arrows 152. The cleaning medium flows into the converging channel 142 formed in the interior 104 of the lance tube nozzle block 102. The converging channel 142 directs the cleaning medium to the inlet end 126 of the downstream nozzle 108. Therefore, the cleaning medium does not substantially flow longitudinally beyond the inlet end 126 of the downstream nozzle 108. In addition, once the flow reaches inlet end 126, there is no flow velocity component in the negative "Z" direction (defined as aligned with axis 136 and positive in the direction of flow discharge). Due to the presence of the converging channel 142, the flow of the cleaning medium is more efficiently driven to the nozzle inlet 126. The loss of energy associated with the cleaning medium entering the throat 134 of the downstream nozzle 108 is reduced, hence increasing the performance of the downstream nozzle 108. Unlike prior art designs, the flowing medium does not have to come to a complete halt in a region beyond the downstream nozzle and then re-accelerate to enter the inlet end 126 of the nozzle 108. Further, since it is also possible to have different geometry for the upstream nozzle 110 and the downstream nozzle 108, the cleaning medium entering the expansion zone 138 in the downstream nozzle 108 is expanded differently than the cleaning medium in the expansion zone 124 of the upstream nozzle 110 so as to compensate for any nozzle inlet pressure difference between the nozzles 108 and 110. The kinetic energy of the cleaning medium exiting the downstream nozzle 108 more closely approximates the kinetic energy of the cleaning medium exiting the upstream nozzle 110.

Figure 5:
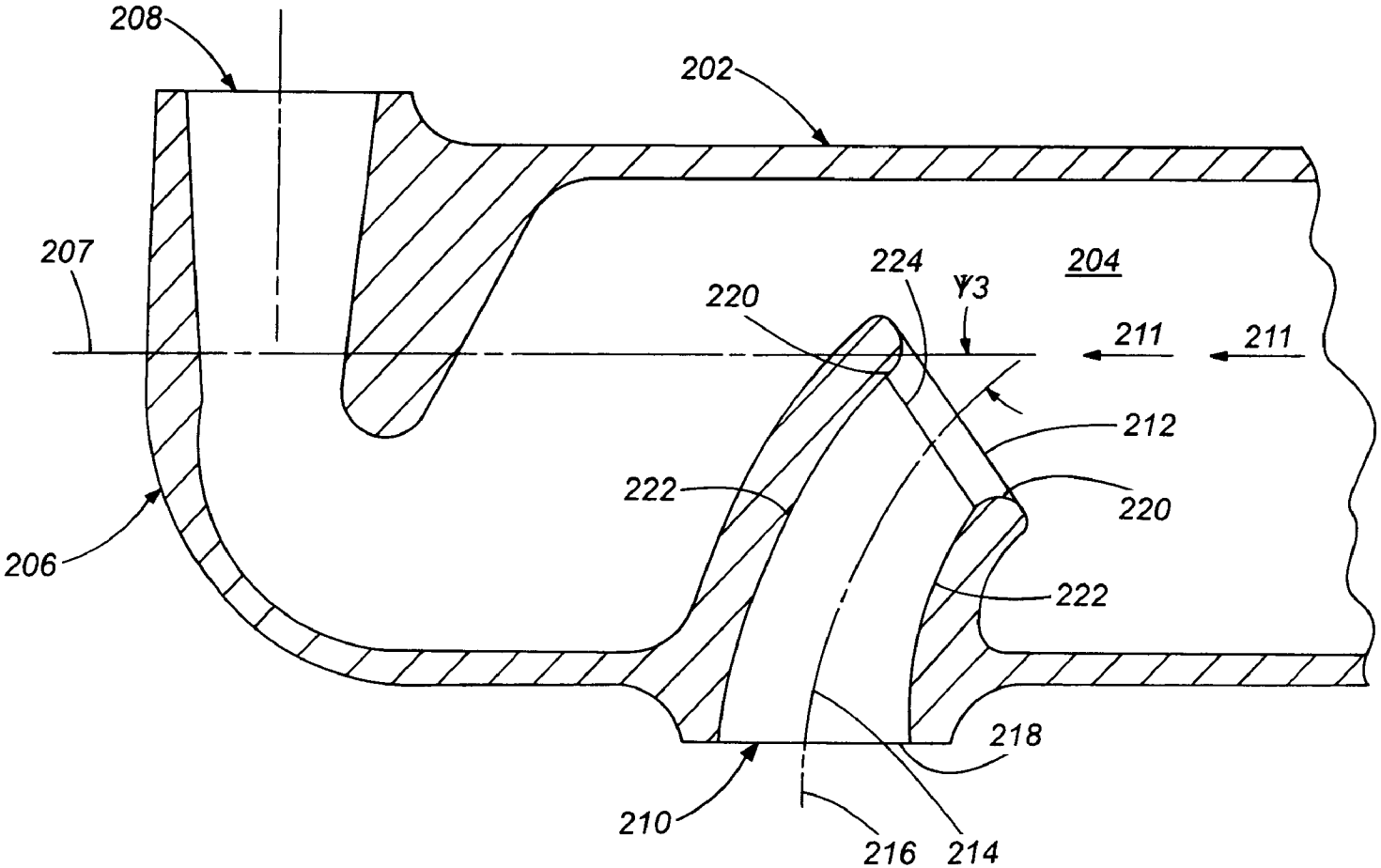
FIG. 5 is a cross-sectional representation of the lance tube nozzle block having a curved upstream nozzle with respect to the longitudinal axis of the lance tube in accordance with another embodiment of the present invention.

Now referring to FIG. 5, a lance tube nozzle block 202 in accordance with another embodiment of the present invention is illustrated. The lance tube nozzle block hollow interior 204 defines a longitudinal axis 207. The lance tube nozzle block 202 has a downstream nozzle 208, positioned at a distal end 206 of the lance tube nozzle block 202. The upstream nozzle 210 is longitudinally spaced from the downstream nozzle 208. In this embodiment, the downstream nozzle 208 has the same configuration as the nozzle 108 of the first embodiment. However, the geometry of the upstream nozzle 210 is different. In this embodiment, the upstream nozzle 210 has a curved interior shape such that the inlet end 212 curves towards the flow of the cleaning medium as shown by arrows 211. The central axis of discharge end 216 as measured from the inlet end 212 to the outlet end 218 is curved and not straight. The upstream nozzle 210 has converging walls 220 and diverging wall 222 joining the converging walls. The converging walls 220 and the diverging walls 222 define a throat 224. A central axis of throat 224 is curved such that the angle ψ3 defined between the throat 224 and the longitudinal axis 207 of the nozzle block 202 is in the range of 0 to 90 degrees. Preferably the angle ψ3 is equal to about 45 degrees.

Figure 6A:
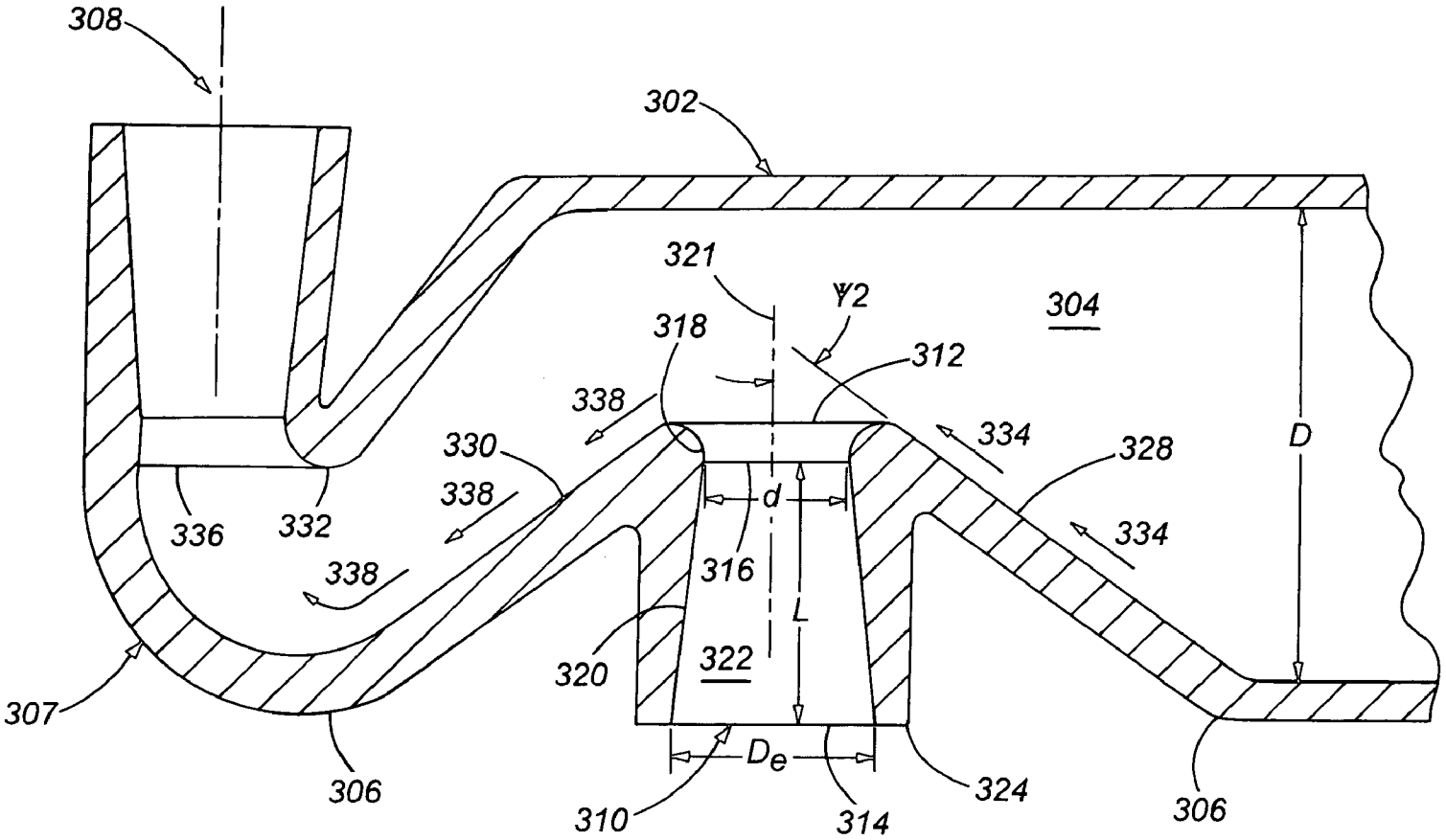
FIGS. 6A and 6B are cross-sectional representations of the lance tube nozzle block in accordance with yet another embodiment of the present invention.
Figure 6B:
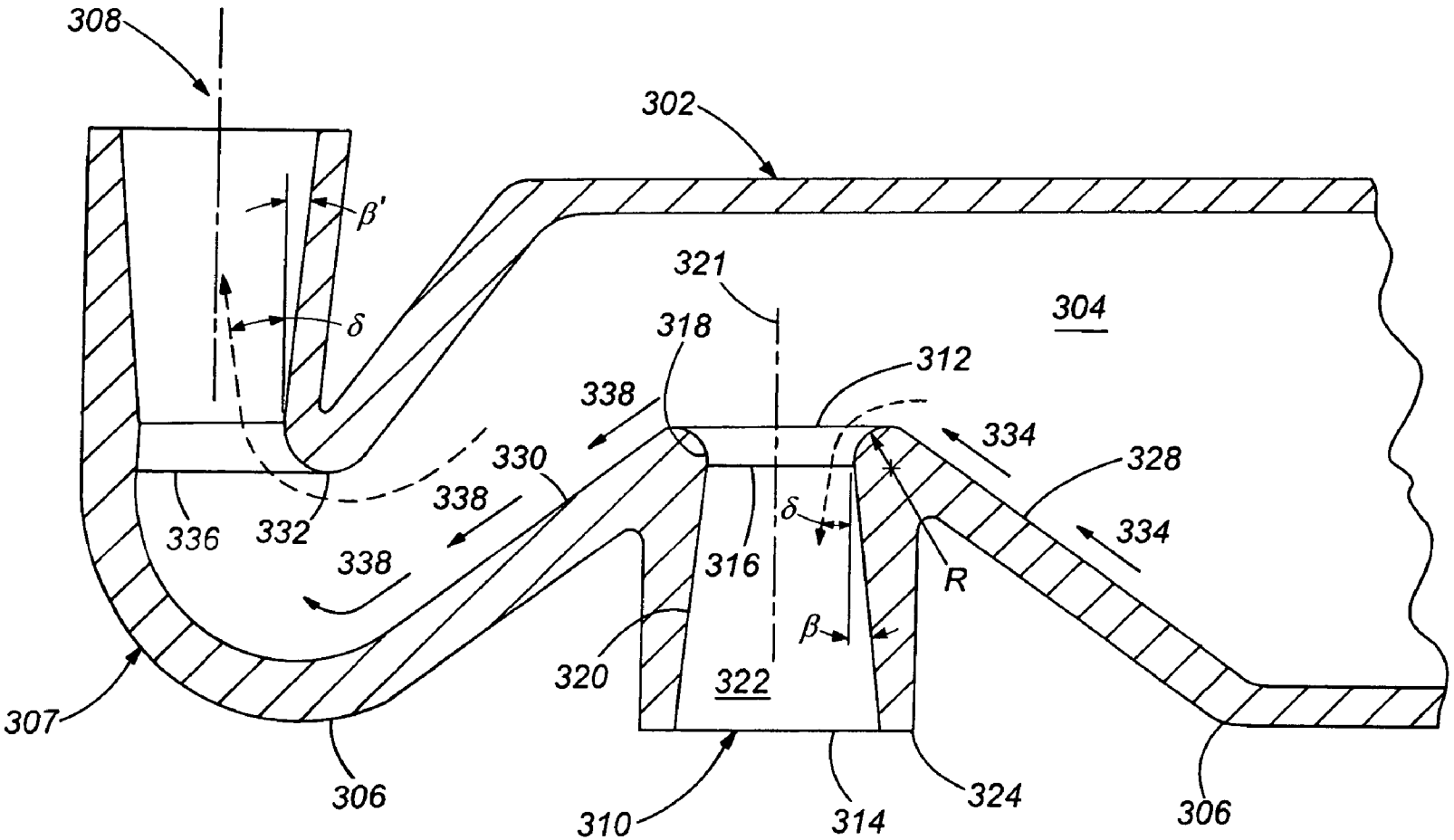

Another embodiment of the present invention shown in FIGS. 6A and 6B as a lance tube nozzle block 302 defines an interior surface 304 and an exterior surface 306. The block 302 is provided with a downstream nozzle 308 positioned at the distal end 307 and an upstream nozzle 310 with an inlet end 312 and an outlet end 314. The upstream nozzle 310 has a throat 316 defined by the converging walls 318 and diverging walls 320, a central axis of discharge 321 extending between the inlet end 312 and the outlet end 314, and a nozzle expansion zone 322 defined by the diverging walls 320. A plane 324 of the outlet end 314 is flush with the exterior surface 306 of the lance tube nozzle block 302. The nozzle block 302 further features a "thin wall" construction in which the outer wall has a nearly uniform thickness, yet forms ramp surfaces 328 and 330, and a tip 332.

The cleaning medium flows in the direction of arrows 334 from the proximal end of the nozzle block towards the upstream ramp 328. The downward ramp 330 allows the cleaning medium to flow smoothly past the upstream nozzle 310 to the inlet end 336 of the downstream nozzle 308 as indicated by arrows 338. The angle of incline $\psi_2$ of the ramp 328 is measured between the central axis 322 of upstream nozzle 310 and the upstream ramp 328. The ramp 330 has a similar angle of incline measured between the central axis 322 and the downstream ramp 330. The ramps 328, 330 provide for a smooth flow of the cleaning medium to the inlet end 336 of the downstream nozzle 308 as shown by arrows 338. Further, the ramps 328, 330 help reduce the turbulent eddies influencing the upstream nozzle 310 and minimize pressure drop of the flow 338 that passes upstream nozzle 310 to feed the downstream nozzle 308.

The performance of the various nozzle assemblies discussed above are optimum when 1) the upstream and downstream nozzles have identical performance, and when 2) each individual nozzle accelerates the cleaning fluid towards the nozzle exit with the exit pressure close to ambient. That is, identical nozzle performance can be characterized as having the same cleaning energy or impact pressure ("PIP"), at a given distance from the boiler wall. Note that the following discussion is directed in particular to the embodiment shown in FIGS. 6A and 6B merely for purposes of illustration. The discussion applies as well to any other previously discussed embodiments.

Recall that the throat-to-exit ratio (see Equations (1) and (2)) is a key parameter for designing nozzles for optimum fluid expansion. A nozzle with an ideal throat-to-exit ratio will achieve uniform, fully expanded, flow at the nozzle exit plane. For a given nozzle size, for example, of the upstream nozzle 310, the exit area is dependent on the nozzle expansion length "L" and the expansion angle "β", as indicated in FIG. 6B. Ideally, a longer expansion length L and minimum expansion angle β are desired to achieve the optimum throat-to-exit ratio without the risk of flow separation at the nozzle expansion wall, since flow separation impacts fluid expansion in a detrimental way. That is, flow separation can result if the expansion angle β is too large. On the other hand, if the angle β is too small, the nozzle length L will have to be excessively long to satisfy the throat-to-exit area requirement. An excessively long nozzle is undesirable since it will 1) violate the requirement that the lance assembly must pass through the wall box opening, and 2) restrict the flow passage to the downstream nozzle.

Figure 7:
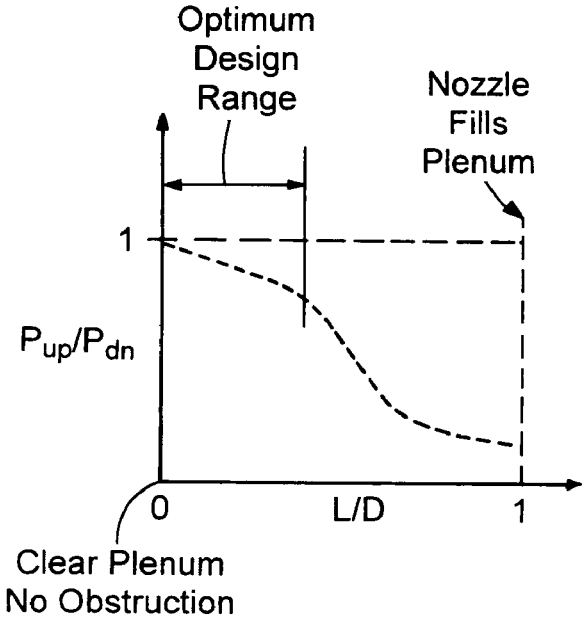
FIG. 7 represents a characteristic curve relating the total pressure loss to the length of a nozzle of the lance tube of FIGS. 6A and 6B.

The upstream nozzle length is limited by the pressure losses caused by the obstruction to the flow stream. A characteristic curve relating total pressure loss to the nozzle length L can be easily generated by experimental testing or computational fluid dynamics ("CFD") analysis. Further, pressure losses can be presented as the ratio of the total pressure at the inlet of the upstream and downstream jets, that is, $P_{up}/P_{dn}$, as a function of L/D, where D is the plenum diameter of the nozzle block 302 (FIG. 7).

Note that the expansion angle β is a function of the nozzle exit area and nozzle length according to the expression:

$$L=(De-d)/(2\cdot\mathrm{Tan}(\beta)), \qquad \text{Equation (4)}$$

where De=nozzle exit diameter. Accordingly, a larger nozzle length L will yield a smaller expansion angle β, and vice versa. Hence, as is understood from FIG. 7, the nozzle length L or the expansion angle β is selected so that the pressure loss is not within the steep part of the characteristic curve.

Thus, it is beneficial to have a larger expansion angle β and shorter nozzle length L to minimize the flow obstruction. However, if the expansion angle β exceeds an upper limit, flow separation may occur, which reduces the effective area of the sonic plane, as expressed in Equation 3, which impacts the jet expansion and the exit Mach number. The characteristic curve of FIG. 8 relates the expansion angle, or nozzle length, to flow separation. In particular, flow separation is quantified by comparing the total pressure at the nozzle centerline, identified as $Po_c$, to that along the nozzle wall but within the same radial plane, identified as $Po_r$.

Figure 8:
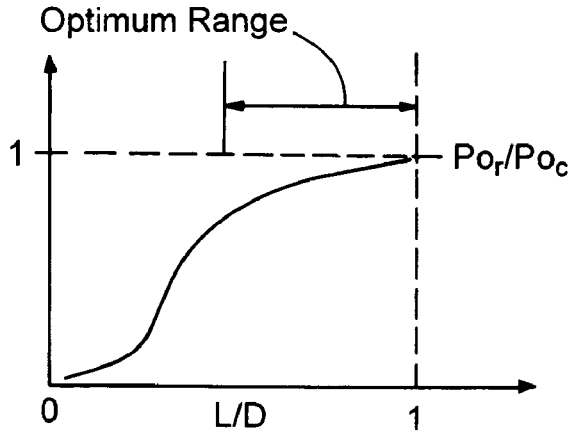
FIG. 8 represents a characteristic curve comparing the total pressure at the nozzle centerline to that along the nozzle wall within the same radial plane relative to the length of the nozzle.

FIG. 8 indicates that longer jets (small expansion angle) minimize flow separation and yield a uniform total pressure along the radial direction. Again, a nozzle length L or the expansion angle β is selected so that the total pressure ratio is not within the steep part of the characteristic curve. In some implementations, the expansion angle is no larger than 10° to avoid severe flow separation.

It's worth noting that FIG. 8 is representative of a flow stream approaching the nozzle throat at a zero approach angle. For most cases, however, the approach angle δ is not zero, as illustrated in FIG. 6B, and therefore the total angle (the sum of δ and β) is considered when developing the characteristic curve.

Ideally, the approach angle δ is minimized by implementing various ramp designs, slanted and/or curved nozzles. Other methods to minimize the approach angle δ include optimizing the converging section radius of curvature "R". For example, CFD analysis can be used to find the optimum radius R that will produce the minimal approach angle.

Figure 9:
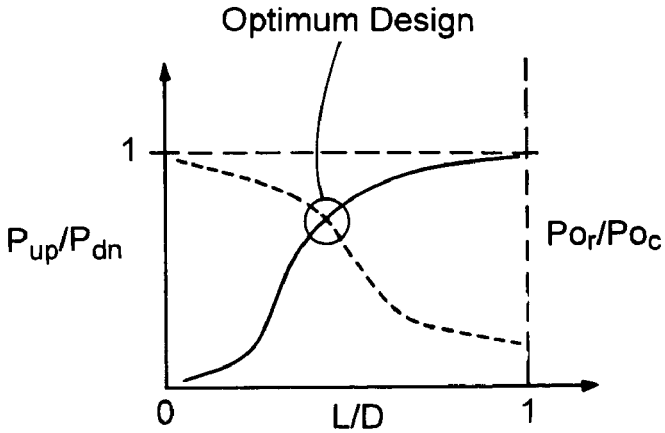
FIG. 9 represents a combination of the characteristic curves of FIGS. 7 and 8 for identifying the optimal design of the nozzle.

By combining both characteristic curves of FIGS. 7 and 8, as illustrated in FIG. 9, a nozzle length L or expansion angle β can be selected that meets the criteria of minimal pressure losses across the upstream nozzle 310 and no flow separation.

As an example, a 3.5 inch outer diameter lance tube provided with an upstream nozzle having a one inch diameter throat (d=1 inch) is selected for operating at a blowing pressure (Po) of about 175 psi. The required exit area or exit diameter is calculated from Equations (1) and (2), namely, Ae=1.618 $in^2$ or De=1.435 inches. Once the individual jet exit area is know, the jet length and expansion angle can be calculated.

From FIG. 9, the optimum nozzle length is less than half the plenum inner diameter, that is L/D≈0.45. Thus, if the plenum inner diameter D is about 3.1 inches, then the length L of the upper nozzle is about 1.4 inches. The equivalent expansion angle according to Equation (4) is therefore approximately 8.8°.

Turning now to the downstream nozzle 308, the throat size of the downstream nozzle is slightly larger to make up for the loss in total pressure due to flow obstruction by the upstream nozzle body. Further, from the characteristic curve of FIG. 7 the downstream total pressure $P_{dn}$ is approximately 20% lower than the upstream pressure $P_{up}$. To make up for the deficit in the total energy available for cleaning, a larger downstream nozzle is therefore desirable. As a guideline, a 10% increase in throat size can cause about a 20% increase in jet impact energy or PIP. Therefore, for this example, the downstream jet has a throat diameter of about 1.1 inches. And from Equations (1) and (2), the exit diameter of the downstream jet is De=1.486 inch.

Once the exit diameter is known, the length of the downstream nozzle 303 can be based on a characteristic curve similar to FIG. 8. Again, experimental testing and/or CFD analysis can be used to develop such a curve. For this example, FIG. 8 can be used to select an L/D for the downstream nozzle that is less conservative than that for the upstream nozzle. For example, if L/D≈0.52, then the appropriate nozzle length is about 1.6 inches and the appropriate expansion angle β' is about 6.9°.

The foregoing discussion discloses and describes a preferred embodiment of the invention. One skilled in the art will readily recognize from such discussion, and from the accompanying drawings and claims, that changes and modifications can be made to the invention without departing from the true spirit and fair scope of the invention as defined in the following claims.

What is claimed is:

1. A lance tube nozzle block for a sootblower, comprising:

a nozzle block body defining a longitudinal axis, a hollow interior, a distal end, and a proximate end with the proximate end receiving the cleaning medium;

a downstream nozzle positioned on the nozzle block body, the downstream nozzle having a first inlet end, a first outlet end, and a first throat positioned between the first inlet end and the first outlet end, the dimensions of the first inlet end, the first outlet end, and the first throat defining a first geometry; and an upstream nozzle positioned longitudinally from the position of the downstream nozzle farther from the distal end than the position of the downstream nozzle, the upstream nozzle having a second inlet end, a second outlet end, and a second throat positioned between the second inlet end and the second outlet end, the dimensions of the second inlet end, the second outlet end, and the second throat defining a second geometry, the first geometry and the second geometry being selected to optimize the cleaning energy of the nozzle block, the cleaning medium flowing in the direction of the longitudinal axis from the proximate end towards the distal end through the nozzle block body hollow interior and entering the downstream and upstream nozzles through the respective first and second inlets and discharging from the downstream and upstream nozzles from the respective outlet ends in directions generally perpendicular to the longitudinal axis.

2. The nozzle block of claim 1 wherein the first throat has a first throat area, the first outlet end has a first exit area, the second throat has a second throat area, and the second outlet end has a second exit area, the ratio of the first exit area to the first throat area being different than the ratio of the second exit area to the second throat area.

3. The nozzle block of claim 1 wherein the downstream nozzle has a first expansion length extending between the first throat and the first outlet end, and the upstream nozzle has a second expansion length extending between the second throat and the second outlet end, the first expansion length being different than the second expansion length.

4. The nozzle block of claim 1 wherein the downstream nozzle has a first expansion length extending between the first throat and the first outlet end, the first outlet end has a first exit diameter, the upstream nozzle has a second expansion length extending between the second throat and the second outlet end, and the second outlet end has a second exit diameter, the ratio of the first expansion length to the first exit diameter being different than the ratio of the second expansion length to the second exit diameter.

5. The nozzle block of claim 1 wherein the downstream nozzle includes a first converging section near the downstream nozzle inlet end and a first diverging section joining the first converging section and terminating with the first outlet end, a first throat area being defined at the the juncture between the first converging section and the first diverging section, and the upstream nozzle includes a second converging section near the upstream nozzle inlet end and a second diverging section joining the second converging section and terminating with the second outlet end, a second throat area of the second throat being defined at the juncture between the second converging section and the second diverging section.

6. The nozzle block of claim 1 wherein the downstream and upstream nozzles are diametrically oriented from one another.

7. The nozzle block of claim 1 wherein the downstream nozzle is positioned adjacent the distal end of the nozzle block body.

8. The nozzle block of claim 7 wherein the flow of the cleaning medium does not flow substantially beyond the downstream nozzle inlet end.

9. The nozzle block of claim 1 wherein the first throat has a first throat diameter and the second throat has a second throat diameter, the first throat diameter being larger than the second throat diameter.

10. The nozzle block of claim 1 wherein the cleaning medium is comprised at least in part of steam.

11. The nozzle block of claim 1 wherein the separation between the first throat and the first outlet end defines a first expansion length and the separation between the second throat and the second outlet end defines a second expansion length, the ratio of the first expansion length to the first throat diameter being different than the ratio of the second expansion length to the second throat diameter.

* * * * *